US008007643B2

(12) United States Patent
Faita et al.

(10) Patent No.: US 8,007,643 B2
(45) Date of Patent: Aug. 30, 2011

(54) ANODE FOR ELECTROLYSIS

(75) Inventors: Giuseppe Faita, Novara (IT); Fulvio Federico, Piacenza (IT)

(73) Assignee: Industrie de Nora S.p.A., Milan (IT)

( * ) Notice: Subject to any disclaimer, the term of this patent is extended or adjusted under 35 U.S.C. 154(b) by 0 days.

(21) Appl. No.: 12/424,949

(22) Filed: Apr. 16, 2009

(65) Prior Publication Data

US 2009/0200162 A1 Aug. 13, 2009

Related U.S. Application Data

(63) Continuation of application No. PCT/EP2007/060863, filed on Oct. 12, 2007.

(30) Foreign Application Priority Data

Oct. 12, 2006 (IT) ..... MI06A1974

(51) Int. Cl.

| | |
|---|---|
| ***C25B 11/04*** | (2006.01) |
| ***C25B 11/06*** | (2006.01) |
| ***C25B 11/08*** | (2006.01) |
| ***C25B 11/10*** | (2006.01) |
| ***C25B 9/06*** | (2006.01) |

(52) U.S. Cl. ..... 204/290.14; 204/290.12; 204/242; 204/252

(58) Field of Classification Search ..... 204/293, 204/292, 291, 290.01, 290.08, 290.09, 290.12, 204/290.13, 290.14

See application file for complete search history.

(56) References Cited

U.S. PATENT DOCUMENTS

| | | | | |
|---|---|---|---|---|
| 3,773,555 | A | 11/1973 | Cotton et al. | |
| 4,049,532 | A | 9/1977 | Clerbois et al. | |
| 4,468,416 | A | 8/1984 | Asano et al. | |
| 4,528,084 | A | 7/1985 | Beer et al. | |
| 4,584,084 | A * | 4/1986 | Asano et al. | 204/290.09 |
| 5,665,218 | A * | 9/1997 | Ashizawa et al. | 205/171 |
| 6,123,816 | A * | 9/2000 | Hodgson | 205/620 |
| 6,527,924 | B1 * | 3/2003 | Andolfatto et al. | 204/290.01 |
| 2003/0136669 | A1 * | 7/2003 | Gestermann et al. | 204/290.12 |
| 2004/0226817 | A1 * | 11/2004 | Hosonuma | 204/280 |
| 2005/0014066 | A1 * | 1/2005 | Shimamune | 429/231.5 |

FOREIGN PATENT DOCUMENTS

GB 1147442 A 4/1969

OTHER PUBLICATIONS

International Search Report for PCT/EP2007/060863 mailed Jan. 25, 2008, p. 1-7.

Written Opinion of the International Searching Authority for PCT/EP2007/060863 mailed Jan. 25, 2008, p. 1-6.

International Preliminary Report on Patentability for PCT/EP2007/060863 mailed Aug. 14, 2008, p. 1-7.

* cited by examiner

*Primary Examiner* — Bruce Bell

(74) *Attorney, Agent, or Firm* — Eshweiler & Associates, LLC

(57) ABSTRACT

The invention relates to an anode comprising a titanium alloy substrate coated with noble metals by thermal decomposition of precursors thereof. The alloy of the substrate includes elements which can be oxidised during the thermal decomposition step, allowing electrical energy savings and a prolonged duration in industrial electrolytic processes. The anode of the invention is suitable for chlor-alkali electrolysis, allowing to produce chlorine with a lower oxygen content and a lower energy consumption than the anodes of the prior art.

10 Claims, No Drawings

ANODE FOR ELECTROLYSIS

CROSS REFERENCE TO RELATED APPLICATIONS

This application is a continuation of PCT/EP2007/060863 filed Oct. 12, 2007, that claims the benefit of the priority date of Italian Patent Application No. MI2006A001974 filed, Oct. 16, 2006, the contents of which are herein incorporated by reference in their entirety.

BACKGROUND

The production of chlorine is essentially carried out by electrolysis of alkali chloride solutions, in particular sodium chloride solutions, by means of three alternative technologies based on diaphragm, mercury cathode or, in the most advanced case, ion-exchange membrane electrolysers, equipped with anodes consisting of expanded or variously perforated titanium sheets provided with an electrocatalytic coating comprising platinum group metals and/or oxides thereof, optionally in admixture. Anodes of such kind are, for instance, commercialised by Industrie De Nora under the trademark DSA®. A common problem to the three technologies is the need of limiting the molar oxygen content in chlorine at levels below 2% and preferably not higher than 1% Oxygen is generated by the unavoidable secondary reaction of water oxidation and hampers most processes making use of chlorine, in particular dichloroethane synthesis, which is the first step of PVC production. According to teachings of the prior art, in order to obtain low oxygen contents the anodes, whose coating is obtained by painting the titanium substrate with a noble metal precursor solution subsequently decomposed by a thermal treatment, are then subjected to a final thermal treatment which entails some energy consumption penalties, estimated on average at about 50-100 kWh/tonne of product depending on the duration and on the temperature applied.

The same anodes are, moreover, employed in hydrochloric acid electrolysis, which is acquiring a growing interest since hydrochloric acid is the typical by-product of all major chlorine-using industrial processes. The increase in the productive capacity of present-day plants involves the generation of remarkable quantities of acid whose allocation on the market is significantly difficult. Hydrochloric acid electrolysis leads to formation of chlorine which can be recycled upstream giving rise to a substantially closed cycle, free of significant environmental impact, which is nowadays a decisive factor to obtain the construction licenses from the competent authorities. The problem characterising the application of noble metal-coated titanium anodes in this context is directly associated with the strong aggressiveness of hydrochloric acid The latter, penetrating through the defects of the electrocatalytic coating, corrodes the titanium-coating interface and provokes the detachment thereof in a relatively short time, with consequent plant shut-down.

A first countermeasure suggested by the prior art, consisting of employing substrates made of titanium-palladium alloy, which is renowned for its peculiar corrosion resistance and used for the construction of critical equipment of chemical plants, has led to no sensible result. A second remedy, consisting of improving the protection of the titanium substrate by increasing the thickness of the catalytic coating, could not be applied beyond certain limits, as it has been observed that excessively thick coatings become extremely brittle and are therefore subject to remarkable detachment phenomena of purely mechanical nature. The preferred solution so far provides the electrocatalytic coating to be obtained as a multiplicity of overlaid individual layers. The thus-obtained anode presents a reduced number of defects and is therefore characterised by a better operative lifetime. Nevertheless, it has been observed that the advantages in terms of prolonged lifetime are counterbalanced by penalties in terms of higher operative voltages, entailing an electrical energy consumption increase of about 50-150 kWh/tonne of chlorine.

Similar problems arise also in all those electrochemical processes, in particular electrometallurgical ones, wherein noble metal-coated titanium electrodes are used as oxygen-evolving anodes: these processes often involve the use of highly concentrated acidic solutions, in particular by sulphuric acid, which turn out to be aggressive for the currently employed titanium substrates. Measures such as those recalled for the hydrochloric acid case are routinely applied with the purpose of obtaining acceptable lifetimes.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, the invention comprises an anode for industrial electrolytic processes overcoming the limitations of the prior art, especially in terms of energy consumption and chemical resistance to acidic solutions. Under another aspect, the invention comprises an anode for industrial chlorine-evolving electrolytic processes overcoming the limitations of the prior art in terms of oxygen content in the product chlorine. Under a further aspect the invention comprises an anode for industrial oxygen-evolving electrolytic processes, for instance electrometallurgical processes, overcoming the limitations of the prior art in terms of duration and operative cell voltage.

To the accomplishment of the foregoing and related ends, the following description and drawings set forth certain illustrative aspects and implementations. These are indicative of but a few of the various ways in which one or more aspects may be employed. Other aspects, advantages, and novel features of the disclosure will become apparent from the following detailed description.

DESCRIPTION

The anode according to the invention comprises a titanium alloy substrate provided with an electrocatalytic coating based on noble metals and/or oxides thereof, the titanium alloy including elements suitable for being oxidised during the formation of the electrocatalytic coating, in one embodiment at a concentration of 0.01 to 5% by weight.

In one embodiment, the anode of the invention comprises a substrate consisting of a titanium alloy including one or more elements selected from the group consisting of aluminium, niobium, chromium, manganese, molybdenum, ruthenium, tin, tantalum, vanadium and zirconium; in another embodiment, such alloy further comprises one or more elements selected among nickel, cobalt, iron and copper.

In one embodiment of the invention, the titanium alloy used as the anode substrate contains 0.02-0.04% by weight ruthenium, 0.01-0.02% by weight palladium, 0.1-0.2% by weight chromium and 0.35-0.55% by weight nickel.

Independently of their final utilisation, titanium anodes with a noble-metal based active coating are manufactured by a procedure comprising the pre-treatment of a titanium substrate by sandblasting and/or attack in acidic solution, and the application of an electrocatalytic coating based on platinum group metals or oxides thereof, optionally in admixture, by thermal decomposition at 450-550° C. of paints containing suitable precursors of the final metals and/or oxides.

The coating may present defects in form of pores or cracks whose presence is believed to be an important cause of operative lifetime reduction in the specific case of operation in the presence of aggressive acidic solutions, as in the case of hydrochloric acid solutions used for hydrochloric acid reconversion to chlorine and of sulphuric acid solutions employed in many electrometallurgical processes. These solutions may creep into the defects until reaching the interface with the titanium substrate and start a corrosion process which in a short time can lead to coating detachment and consequent electrolyser shut-down.

It was demonstrated that the defect population is a function of the coating application procedure. In particular, the past experience indicates that the higher the thickness (or specific loading), the lower the presence of defects in the electrocatalytic coating. On the other hand, for a given thickness or specific loading, the more fractioned the application—in other words, the higher the number of individual layers applied—the lower the presence of defects. In the latter case it is apparent that the overall thermal treatment, which is a function of the number of individual layers, may be protracted for quite a long time.

In the case of anodes for electrolysis of acidic solutions, similarly lengthy thermal treatments are also necessary to endow the coating with an adequate resistance to dissolution. It is presumable that this positive effect is associated with crystallisation processes of the coating material leading to elimination of the more vulnerable amorphous fraction.

A similar situation is also experienced when this kind of anode is employed in chlor-alkali electrolysis, with the industrial users often requiring the oxygen content in chlorine to stay below certain limits, for example less than 2% and preferably less than 1%. Such a result is, in fact, obtained by subjecting the anodes to a further final thermal treatment.

The industrial experience has shown that extending the duration of treatments at temperatures of 450° C. to 550° C., although allowing to achieve the above mentioned advantages, entails a rather severe penalty in terms of electrochemical working potential decrease, with a corresponding increase in the electrical energy consumption of up to 100 kWh/ton in the case of chlorine production.

As an example of such penalties, in the following Table 1 are reported the data relative to the electrochemical potential $E_{Cl2,SCE}$ (SCE=saturated calomel reference electrode) and the oxygen content in chlorine as a function of the overall thermal treatment time (d, given in hours) obtained with anodes for chlorine evolution in chlor-alkali electrolysis, the other production parameters remaining constant (substrate of pure titanium grade 1 according to ASTM B 265, electrocatalytic coating consisting of non-stoichiometric mixed oxide of ruthenium, iridium and titanium, $RuIrTiO_X$).

TABLE 1

| d (h) | 1 | 2 | 3 | 4 | 5 |
|---|---|---|---|---|---|
| $E_{Cl2,SCE}$ (V) | 1.08 | 1.10 | 1.14 | 1.18 | 1.25 |
| % $O_2$ | 2.20 | 1.95 | 1.60 | 1.25 | <1 |

Entirely similar results were obtained making use of titanium-palladium alloy as the substrate (ASTM B 265, grade 7, palladium 0.12-0.25% by weight), whose higher cost would even have been acceptable, at least in some applications, in exchange for possible voltage and lifetime gains.

The inventors have surprisingly observed that it is possible to manufacture anodes with lengthy overall thermal treatment times without experiencing a sensible deterioration of the electrochemical working potentials when the substrate consists of suitable titanium alloys, in contrast with the teachings of the prior art. The invention, therefore, provides anodes of higher quality capable both of functioning with extended operative lifetimes in hydrochloric acid solution electrolysis or in sulphuric acid-containing electrolytes currently employed in electrometallurgy, and of producing chlorine with low oxygen percentages in chlorine-caustic soda electrolysis.

In particular, very interesting results were obtained with titanium alloys containing one or more elements of a first set comprising aluminium, niobium, chromium, manganese, molybdenum, ruthenium, tin, tantalum, vanadium and zirconium, optionally added with elements of a second set comprising nickel, cobalt, iron, copper. It was also found that titanium alloys only containing one or more elements of the second set proved less efficient in preventing the electrochemical potential deterioration under the effect of a lengthy heating. Moreover, the presence of iridium, rhodium, palladium and platinum in the alloy turned out to be irrelevant, even though the addition of such elements may in any case be advantageous to prevent certain kinds of corrosive attacks which take place when anodes remain immersed in aggressive solutions during electrolyser shut-down procedures, as known to those skilled in the art.

Without being bound to any particular theory, a possible explanation of the positive effects of the elements of the first set, as hereinbefore defined, might be given considering first of all the reasons for the electrochemical potential increase of titanium anodes subjected to lengthy thermal treatments. It is a widely held opinion that the potential decay is caused by the growth of a titanium oxide film at the interface between coating and substrate during the coating formation step. Since the thermal treatment is carried out at 450-550° C. in the presence of air, titanium metal is, in fact, prone to be oxidised by oxygen diffusing across the coating. Titanium oxide produced in this way is scarcely conductive, becoming a site for an ohmic drop adding up to the real electrochemical potential during operation Such ohmic drop is of modest extent, so that its impact on the electrochemical potential remains negligible until the titanium oxide film is thin enough. The latter is true only if the overall thermal treatment duration does not exceed certain values, which is the contrast with the need of producing anodes characterised by satisfactory operative lifetime in aggressive environments (reduced number of individual layers with still significant residual defects) or by low oxygen percentages in chlor-alkali applications.

The elements of the first set, as hereinbefore defined, are firstly characterised by being easily oxidised in the process conditions typical of electrocatalytic coating application, particularly as regards temperature and presence of air. It can be thus supposed that these elements act as dopants of titanium oxide, which acquires thereby a far higher electrical conductivity than the corresponding oxide which grows on unalloyed titanium. A second aspect might be given by the capability of forming solid solutions, at least at the low concentrations of use, typically in the range 0.01-5% by weight. The solid solutions wherein the alloyed elements are uniformly dispersed would allow the same elements to disperse in a similarly uniform manner in the superficial titanium oxide phase, endowing it with the same above seen characteristics of electrical conductivity even at a modest content of alloyed elements. The elements of the second set, also oxidisable during coating formation, are nevertheless known to give rise in general to segregated phases in form of microparticles dispersed within the metal matrix and in particular localised in correspondence of the crystal grain borders. As a possible consequence of this discontinuous distribution on a microscopic scale, their presence inside the titanium oxide is also likely to be inhomogeneous, with a less pronounced effect on the electrical conductivity.

Some of the more significant results obtained by the inventors are presented in the following examples, which shall not be intended as limiting the scope of the invention.

Example 1

Some anodes directed to chlorine evolution by hydrochloric acid electrolysis were prepared by adopting the following procedure:

a. acquisition of the following titanium alloys as 1 mm thick sheets (content of additional elements as weight percentage):
   Alloy 1: titanium-ruthenium (0.08/0.14%)
   Alloy 2: titanium-aluminium (1.0/2.0%)
   Alloy 3: titanium-tantalum (5%)
   Alloy 4: titanium-aluminium (2.5/3.5%)-vanadium (2.0/3.0%)
   Alloy 5: titanium-molybdenum (0.2/0.4%)-nickel (0.6/0.9%)
   Alloy 6: titanium-chromium (0.1/0.2%)-nickel (0.35/0.55%)-ruthenium (0.02/0.04%)-palladium (0.01/0.02%)
   Alloy 7: titanium-palladium (0.12/0.25%) (reference prior art)
   Alloy 8: titanium-iron (0.5%)
   Alloy 9: pure titanium grade 1 according to ASTM B 265 (reference prior art)
b. cold cutting of the previous sheets in square plates of 5 cm side
c. pre-treatment of one side of each plate by sandblasting followed by degreasing and hydrochloric acid etching
d. application on the pre-treated side of a coating consisting of ruthenium and titanium mixed oxide comprised of a multiplicity of individual layers, each layer being obtained by thermal decomposition of an aqueous paint containing the chlorides of the two metals at 480-490° C. during 10 minutes, for a total of 25 layers corresponding to an overall ruthenium loading of 50 mg.

The thus-activated plates, with the addition of a further plate identified as alloy 9B and provided with a coating with the same composition and loading, but obtained by application of only 13 individual layers followed by a final thermal treatment of 4 hour overall duration on a 9 type alloy, were operated at a current density of 0.5 A/m$^2$ in electrolysis cells fed with 14% by weight hydrochloric acid at 60° C. A perfluorinated Nafion® 324 ion-exchange membrane commercialised by DuPont/USA subdivided the cells into two compartments, anodic and cathodic, respectively containing the plates under test and zirconium cathodes of the same size. During electrolysis the electrochemical potentials $E_{Cl2,SCE}$ (V, reference: saturated calomel) of the plates working as chlorine-evolving anodes were measured, and periodic tests of coating adhesion were carried out The relevant data are collected in Table 2.

The data of Table 2 show that the use of titanium alloys containing, according to the invention, elements of the first set, first of all allows meeting the target of operating at low electrochemical potentials with an electrical energy saving around 50-100 kWh/tonne of chlorine, even though a manufacturing procedure comprising the deposition of a high number of individual layers is followed in order to obtain coatings virtually free of through defects. Such a result of high industrial relevance furthermore goes along with a remarkable stability of the coating, which is not affected by significant detachments from the substrate.

The data in Table 2 demonstrate that the elements of the second set as hereinbefore defined, provided they are present in significant amounts, are per se capable of guaranteeing improved electrochemical potentials over the prior art, albeit of lesser extent than those obtainable with alloying elements of the first set (see alloy 8).

Finally, the data in Table 2 indicate that the performances of the anodes in accordance with the invention prove largely superior with respect to both those of the anodes comprising coatings made of few but highly defective individual layers (see alloy 9B, prior art) and those of anodes with coatings consisting of many individual layers applied to pure titanium or to titanium alloys containing non-oxidisable elements such as palladium (see alloy 9 and alloy 7, prior art).

Example 2

Some anodes for electrolysis of sodium chloride solutions were prepared by adopting the following procedures:

a. acquisition of the following titanium alloys as 1 mm thick sheets (content of additional elements as weight percentage):
   Alloy 2: titanium-aluminium (1.0/2.0%)
   Alloy 5: titanium-molybdenum (0.2/0.4%)-nickel (0.6/0.9%)
   Alloy 6: titanium-chromium (0.1/0.2%)-nickel (0.35/0.55%)-ruthenium (0.02/0.04%)-palladium (0.01/0.02%)
   Alloy 9: pure titanium grade 1 according to ASTM B 265 (reference prior art)
b. cold cutting of the previous sheets in square plates of 5 cm side
c. pre-treatment of one side of each plate by sandblasting followed by degreasing and hydrochloric acid etching
d. application on the pre-treated side of a coating consisting of ruthenium, iridium and titanium mixed oxide comprised of a multiplicity of individual layers, each layer being obtained by thermal decomposition of an aqueous paint containing the chlorides of the three metals at 490-500° C. during 10 minutes, for a total of 11 layers corresponding to

TABLE 2

| | alloy 1 | alloy 2 | alloy 3 | alloy 4 | alloy 5 | alloy 6 | Alloys 7 and 9 | alloy 8 | alloy 9B |
|---|---|---|---|---|---|---|---|---|---|
| $E_{Cl2,SCE}$ (init.) | 1.060 | 1.062 | 1.064 | 1.055 | 1.060 | 1.060 | 1.200-1.210 | 1.15 | 1.190 |
| $E_{Cl2,SCE}$ (1000 hours) | 1.070 | 1.065 | 1.070 | 1.070 | 1.065 | 1.065 | 1.220-1.225 | 1.17 | 1.180 |
| $E_{Cl2,SCE}$ (2000 hours) | 1.070 | 1.070 | 1.090 | 1.085 | 1.075 | 1.065 | 1.240-1.250 | 1.16 | 1.235 |
| adhesion test | positive | positive | positive | local detachments | positive | positive | positive | local detachments | negative |

an overall ruthenium+iridium loading of 55 mg. The plates were further subjected to final thermal treatments for a duration (d) of 1 to 4 hours.

The thus-activated plates were operated at a current density of 0.4 A/m$^2$ in electrolysis cells at 90° C. A perfluorinated Nafion® 982 ion-exchange membrane commercialised by DuPont/USA subdivided the cells into two compartments, anodic and cathodic, with the plates under test and nickel cathodes of the same dimensions installed therein. The two compartments respectively contained a sodium chloride solution at a concentration of 220 g/l and pH 3 and a 32% by weight sodium hydroxide solution.

During electrolysis the electrochemical potentials $E_{Cl2,SCE}$ (V, reference: saturated calomel) of the plates working as chlorine-evolving anodes and the oxygen content in product chlorine were measured. The relevant data are collected in Table 3.

TABLE 3

| | oxygen in chlorine (mol %) | $E_{Cl2,SCE}$ |
|---|---|---|
| alloy 2, d = 0 hours | 2.4 | 1.08 |
| alloy 2, d = 2 hours | 1.6 | 1.10 |
| alloy 2, d = 4 hours | 1.1 | 1.10 |
| alloy 5, d = 0 hours | 2.3 | 1.09 |
| alloy 5, d = 2 hours | 1.7 | 1.08 |
| alloy 5, d = 4 hours | 1.0 | 1.09 |
| alloy 6, d = 0 hours | 2.3 | 1.07 |
| alloy 6, d = 2 hours | 1.6 | 1.08 |
| alloy 6, d = 4 hours | 0.9 | 1.08 |
| alloy 9, d = 0 hours | 2.4 | 1.08 |
| alloy 9, d = 2 hours | 1.5 | 1.16 |
| alloy 9, d = 4 hours | 0.8 | 1.25 |

The data in Table 3 show that in the case of anodes according to the invention comprising a suitable titanium alloy as the substrate, it is possible to carry out a final thermal treatment in order to diminish the oxygen content in chlorine to levels of complete industrial satisfaction without any significant potential penalty taking place. Such a result is not obtainable with the anodes according to the prior art wherein the titanium substrate, free of the alloying elements in accordance with the invention, forms a non-conductive oxide, which grows thicker with the protraction of the thermal treatment to which the anode is subjected (see alloy 9). The growth of the non-conductive oxide entails an obvious worsening of the anodic working potential, which can be quantified as about 100 kWh/tonne of chlorine.

Example 3

Two pairs of 1 mm thick square plates of 2 cm side, obtained by cold cutting of alloy 6 and alloy 9 (prior art) sheets were treated as follows:

a. pre-treatment of one side of each plate by heavy sand-blasting in order to produce a high degree of surface-roughness, followed by degreasing and hydrochloric acid etching
b. application to the pre-treated side of each plate of a coating comprising iridium and titanium mixed oxide comprised of a multiplicity of individual layers, each layer being obtained by thermal decomposition of an aqueous paint containing the chlorides of the two metals at 490-500° C. during 10 minutes, for a total of 16 layers corresponding to an overall iridium loading of 32 mg.

The plates were installed in undivided cells containing a 10% by weight sulphuric acid solution at 60° C. and zirconium cathodes of the same size. The plates were operated as anodes for oxygen evolution at a current density of 2 A/cm$^2$ in order to simulate substantially more severe operating conditions than those typical of electrometallurgical processes such as fast zinc electroplating of steel sheets or copper-foil deposition of controlled thickness.

During operation the electrochemical potentials of the plates were detected. The measured values were 1.35 V/SCE and 1.55 V/SCE respectively for the anodes according to the invention consisting of the catalytic coating applied to alloy 6 and for the anodes in accordance with the prior art wherein the electrocatalytic coating was applied to titanium free of alloying elements (alloy 9). Thus, similarly to what was seen in Example 1 for hydrochloric acid solution electrolysis, also in the case of anodes suitable to be operated in electrometallurgical processes in contact with aggressive sulphuric solutions, electrocatalytic coatings comprised of a multiplicity of individual layers can be advantageously applied, allowing to eliminate or at least reduce to marginal levels the presence of defects which might hamper the lifetime without simultaneously incurring an electrochemical potential penalty.

Although the disclosure has been shown and described with respect to one or more embodiments and/or implementations, equivalent alterations and/or modifications will occur to others skilled in the art based upon a reading and understanding of this specification. The disclosure is intended to include all such modifications and alterations and is limited only by the scope of the following claims. In addition, while a particular feature may have been disclosed with respect to only one of several embodiments and/or implementations, such feature may be combined with one or more other features of the other embodiments and/or implementations as may be desired and/or advantageous for any given or particular application. Furthermore, to the extent that the terms "includes", "having", "has", "with", or variants thereof are used in either the detailed description or the claims, such terms are intended to be inclusive in a manner similar to the term "comprising."

The invention claimed is:

1. Anode for electrochemical processes comprising a metallic substrate provided with an electrocatalytic coating containing platinum group metals and/or oxides thereof formed by a multiplicity of individual layers obtained by thermal decomposition of soluble precursors, the metallic substrate being made of a titanium alloy containing at least one element oxidisable in the conditions of said thermal decomposition, said at least one oxidisable element being selected from a first set comprising aluminium, niobium, chromium, manganese, molybdenum, ruthenium, tin, tantalum, vanadium and zirconium, said metallic substrate further comprising a titanium oxide layer interposed between the metallic substrate and the electrocatalytic coating, wherein an oxide of said at least one oxidisable element, obtained during said thermal decomposition, is partially dispersed inside the titanium oxide layer.

2. The anode of claim 1, the titanium alloy of the metallic substrate further comprising at least one element selected from a second set comprising one or more of nickel, cobalt, iron and copper.

3. The anode of claim 1, the at least one oxidisable element present at a concentration of 0.01 to 5% by weight.

4. The anode of claim 1, the titanium alloy including 0.02-0.04% by weight ruthenium, 0.01-0.02% by weight palladium, 0.1-0.2% by weight chromium and 0.35-0.55% by weight nickel.

5. The anode of claim 1, the individual layers comprising successively thermally decomposed layers having a thermal decomposition of overall duration higher than 1 hour.

6. Anode for electrochemical processes comprising a metallic substrate provided with an electrocatalytic coating containing platinum group metals and/or oxides thereof formed by a multiplicity of individual layers obtained by thermal decomposition of soluble precursors, the metallic substrate being made of a titanium alloy including 0.02-0.04% by weight ruthenium, 0.01-0.02% by weight palladium, 0.1-0.2% by weight chromium and 0.35-0.55% by weight nickel.

7. An electrolytic cell comprising an anode comprising a metallic substrate provided with an electrocatalytic coating containing platinum group metals and/or oxides thereof formed by a multiplicity of individual layers obtained by thermal decomposition of soluble precursors, the metallic substrate consisting of a titanium alloy containing at least one element oxidisable in the conditions of said thermal decomposition, said at least one oxidisable element being selected from a first set comprising aluminium, niobium, chromium, manganese, molybdenum, ruthenium, tin, tantalum, vanadium and zirconium, said metallic substrate further comprising a titanium oxide layer interposed between the metallic substrate and the electrocatalytic coating, wherein an oxide of said at least one oxidisable element, obtained during said thermal decomposition, is partially dispersed inside the titanium oxide layer.

8. The cell of claim 7, the anode comprising an anode in a cell for the electrolysis of a hydrochloric acid solution.

9. The cell of claim 7, the anode comprising an anode in a cell for a chlorine-caustic soda electrolysis process.

10. The cell of claim 7, the anode comprising an anode in a cell for an electrometallurgical process with oxygen anodic evolution in an acidic electrolyte.

* * * * *